US011798718B2

(12) United States Patent
Ogawa et al.

(10) Patent No.: US 11,798,718 B2
(45) Date of Patent: Oct. 24, 2023

(54) SOFT MAGNETIC ALLOY, SOFT MAGNETIC ALLOY RIBBON, METHOD OF MANUFACTURING SOFT MAGNETIC ALLOY RIBBON, MAGNETIC CORE, AND COMPONENT

(71) Applicant: PROTERIAL, LTD., Tokyo (JP)

(72) Inventors: Yuichi Ogawa, Tokyo (JP); Naoki Itoh, Tokyo (JP); Takahiro Shiratake, Tokyo (JP); Motoki Ohta, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 58 days.

(21) Appl. No.: 17/132,544

(22) Filed: Dec. 23, 2020

(65) Prior Publication Data

US 2021/0202144 A1 Jul. 1, 2021

(30) Foreign Application Priority Data

Dec. 26, 2019 (JP) ..... 2019-236175
Dec. 8, 2020 (JP) ..... 2020-203597

(51) Int. Cl.

| | |
|---|---|
| ***H01F 1/147*** | (2006.01) |
| ***B22D 11/049*** | (2006.01) |
| ***C21D 6/00*** | (2006.01) |
| ***C21D 9/52*** | (2006.01) |
| ***C22C 38/02*** | (2006.01) |

(Continued)

(52) U.S. Cl.

CPC ..... *H01F 1/14766* (2013.01); *B22D 11/049* (2013.01); *C21D 6/001* (2013.01); *C21D 6/005* (2013.01); *C21D 6/007* (2013.01); *C21D 6/008* (2013.01); *C21D 9/52* (2013.01); *C22C 38/02* (2013.01); *C22C 38/08* (2013.01); *C22C 38/10* (2013.01); *C22C 38/12* (2013.01);

(Continued)

(58) Field of Classification Search

None

See application file for complete search history.

(56) References Cited

U.S. PATENT DOCUMENTS 8,414,712 B2 * 4/2013 Yoshizawa ..... C21D 9/52 420/117
2010/0084056 A1 * 4/2010 Ohta ..... C22C 33/003 148/540

(Continued)

FOREIGN PATENT DOCUMENTS

EP 2149616 A1 2/2010
JP H01156451 A 6/1989

(Continued)

OTHER PUBLICATIONS

Search Report issued in EP Application No. 20216293.9-1103; dated May 31, 2021; 11 pages.

*Primary Examiner* — Daniel J. Schleis
(74) *Attorney, Agent, or Firm* — Meunier Carlin & Curfman LLC

(57) ABSTRACT

The soft magnetic alloy of the present disclosure is represented by a composition formula of $Fe_aSi_bB_cCu_dM_e$ where M is at least one type of element selected from a group consisting of Nb, Mo, V, Zr, Hf, and W, and the formula satisfies $82.5 \leq a \leq 86$, $0.3 \leq b \leq 3$, $12.5 \leq c \leq 15.0$, $0.05 \leq d \leq 0.9$, and $0 \leq e < 0.4$ in at %. The soft magnetic alloy includes a structure that has a crystal grain with a grain diameter of 60 nm or less in an amorphous phase.

10 Claims, 2 Drawing Sheets

(51) Int. Cl.

| | |
|---|---|
| ***C22C 38/08*** | (2006.01) |
| ***C22C 38/10*** | (2006.01) |
| ***C22C 38/12*** | (2006.01) |
| ***C22C 38/16*** | (2006.01) |
| ***H01F 41/02*** | (2006.01) |
| *H01F 27/25* | (2006.01) |

(52) U.S. Cl.
CPC ..... *C22C 38/16* (2013.01); *H01F 41/02* (2013.01); *H01F 27/25* (2013.01)

(56) References Cited

U.S. PATENT DOCUMENTS

| | | | | |
|---|---|---|---|---|
| 2016/0196907 | A1* | 7/2016 | Ohta ..... | C21D 1/18<br>148/108 |
| 2019/0185950 | A1 | 6/2019 | Onodera et al. | |
| 2020/0357547 | A1 | 11/2020 | Harada et al. | |

FOREIGN PATENT DOCUMENTS

| | | | |
|---|---|---|---|
| JP | 2019094532 | A | 6/2019 |
| WO | 2008133301 | A1 | 11/2008 |
| WO | 2018025931 | A1 | 2/2018 |

* cited by examiner

SOFT MAGNETIC ALLOY, SOFT MAGNETIC ALLOY RIBBON, METHOD OF MANUFACTURING SOFT MAGNETIC ALLOY RIBBON, MAGNETIC CORE, AND COMPONENT

CROSS-REFERENCE TO RELATED APPLICATIONS

This application claims the benefit of Japanese Patent Application No. 2019-236175 filed Dec. 26, 2019 and Japanese Patent Application No. 2020-203597 filed Dec. 8, 2020 in the Japan Patent Office, the entire disclosure of which is incorporated herein by reference.

TECHNICAL FIELD

The present disclosure relates to a soft magnetic alloy, a soft magnetic alloy ribbon, a method of manufacturing the soft magnetic alloy ribbon, a magnetic core, and a component.

BACKGROUND

Soft magnetic alloys having nano-crystalline structures provide an excellent magnetic property and are applied in transformers, electronic components, motors, and the like, which are demanded to be downsized and highly efficient. Therefore, soft magnetic alloys used in such applications are accordingly demanded to further improve their properties. Demanded properties of the soft magnetic alloys include high saturation magnetic flux density and a low iron loss. As many of these components have been in process of downsizing by increasing a clock frequency to be compatible with substances such as semiconductors that have been made for higher frequencies, attentions are now paid to Fe-based non-crystalline alloys and Fe-based nano-crystallized alloys with a low iron loss. To commercially distribute these Fe-based non-crystalline alloys and Fe-based nano-crystallized alloys, soft magnetic alloys with excellent cost performance, productivity, and annealing processability are in demand.

Patent Document 1 discloses a method of manufacturing a soft magnetic material having both high saturation magnetic flux density and low coercivity by preparing an alloy having a composition that is represented by a composition formula of $Fe_{100-a-b-c}B_aCu_bM'_c$ in which M' is at least one type of element selected from a group consisting of Nb, Mo, Ta, W, Ni, and Co, the formula satisfies $10 \le a \le 16$, $0 < b \le 2$, and $0 \le c \le 8$, and the alloy also has a non-crystalline phase; heating the alloy at a heating rate of 10° C./second or more, and retaining the alloy at or above a crystallization starting temperature and below an Fe—B compound formation starting temperature for a period of zero to 80 seconds.

Patent Document 2 discloses a soft magnetic alloy represented by a composition formula of $((Fe_{(1-(\alpha+\beta))}X1_\alpha X2_\beta)_{(1-(a+b+c+d+e))}B_aSi_bC_cCu_dM_e$ where X1 is one or more types of element selected from a group consisting of Co and Ni; X2 is one or more types of element selected from a group consisting of Al, Mn, Ag, Zn, Sn, As, Sb, Bi, N, O, and rare earth elements; M is one or more types of element selected from a group consisting of Nb, Hf, Zr, Ta, Ti, Mo, W, and V; and the formula satisfies $0.140 < a \le 0.240$, $0 \le b \le 0.030$, $0 < c < 0.080$, $0 < d \le 0.020$, $0 \le e \le 0.030$, $\alpha \ge 0$, $\beta \ge 0$, and $0 \le \alpha + \beta \le 0.50$. This soft magnetic alloy is disclosed to simultaneously satisfy a high saturation magnetic flux density, low coercivity, and high magnetic permeability W.

Patent Document 3 discloses a soft magnetic alloy represented by a composition formula of $Fe_{100-x-y-z}A_xM_yX_z$, where A is at least one or more types of element selected from a group consisting of Cu and Au; M is at least one or more types of element selected from a group consisting of Ti, Zr, Hf, V, Nb, Ta, Cr, Mo, and W; X is at least one or more types of element selected from a group consisting of B and Si; the formula satisfies $0 < x \le 5$, $0.4 \le y < 2.5$, and $10 \le z \le 20$ in atomic percent (at %). A saturation magnetic flux density of the soft magnetic alloy is 1.7 T or more, and coercivity of the soft magnetic alloy is 15 A/m or less.

PRIOR ART DOCUMENTS

Patent Documents

Patent Document 1: International Patent Application Publication No. 2018/025931

Patent Document 2: Japanese Unexamined Patent Application Publication No. 2019-094532

Patent Document 3: International Patent Application Publication No. 2008/133301

SUMMARY

Problems to be Solved by the Invention

Patent Document 1 discloses a soft magnetic material that has a high-saturation magnetic flux density. However, the soft magnetic material disclosed in Patent Document 1 does not contain Si, and therefore, an $SiO_2$ oxide layer that contributes to corrosion resistance of the soft magnetic material is not formed on a surface of the soft magnetic material. This causes a difficulty in preventing corrosion such as rust.

A saturation magnetic flux density (Bs) of the soft magnetic alloy disclosed in Patent Document 2 is not so high. In general, the saturation magnetic flux density increases as an amount of Fe content increases. However, in sixth embodiment of Patent Document 2, in which the amount of Fe content is 84 at %, the saturation magnetic flux density (Bs) is 1.76 T. In addition, a relatively high amount of B content suggests that the annealing processability is not sufficient.

The soft magnetic alloy disclosed in Patent Document 3 contains a large amount of expensive M elements, such as Nb, and therefore is expensive. In addition, the soft magnetic alloy has anisotropy in its casting direction and has a large ratio of the magnetic flux density when imposing a magnetic field of 80 A/m in the casting direction to the magnetic flux density when imposing the magnetic field of 80 A/m in a direction orthogonal to the casting direction. Therefore, the soft magnetic alloy of Patent Document 3 is not suitable for an application that requires isotropy.

Desirably, the present disclosure provides a soft magnetic alloy that has a high saturation magnetic flux density and a low iron loss; a soft magnetic alloy ribbon made of the soft magnetic alloy; a method of manufacturing the soft magnetic alloy ribbon; a magnetic core formed by using the soft magnetic alloy ribbon; and a component.

Means for Solving the Problems

Specific measures for solving the aforementioned problems include the following aspects.

One aspect of the present disclosure is a soft magnetic alloy represented by a composition formula of $Fe_aSi_bB_cCu_dM_e$, M being at least one type of element selected from a group consisting of Nb, Mo, V, Zr, Hf, and W, and the formula satisfying $82.5 \le a \le 86$, $0.3 \le b \le 3$, $12.5 \le c \le 15.0$, $0.05 \le d \le 0.9$, and $0 \le e < 0.4$ in at %.

The soft magnetic alloy includes a structure that has a crystal grain with a grain diameter of 60 nm or less in an amorphous phase.

In the composition formula of the soft magnetic alloy, a part of Fe content is preferably replaced with at least one type of element selected from Co and Ni up to 6 at % at a maximum.

A saturation magnetic flux density of the soft magnetic alloy is preferably 1.75 T or more.

A density of the soft magnetic alloy is preferably 7.45 $g/cm^3$ or more.

One aspect of the present disclosure is a soft magnetic alloy ribbon including an alloy represented by a composition formula of $Fe_aSi_bB_cCu_dM_e$, M being at least one type of element selected from a group consisting of Nb, Mo, V, Zr, Hf, and W, and the formula satisfying $82.5 \le a \le 86$, $0.3 \le b \le 3$, $12.5 \le c \le 15.0$, $0.05 \le d \le 0.9$, and $0 \le e < 0.4$ in at %.

The soft magnetic alloy ribbon includes a structure that has a crystal grain with a grain diameter of 60 nm or less in an amorphous phase. A saturation magnetic flux density of the soft magnetic alloy ribbon is 1.75 T or more. An iron loss of the soft magnetic alloy ribbon at 1 kHz and at 1 T is 25 W/kg or less.

A density of the soft magnetic alloy ribbon is preferably 7.45 $g/cm^3$ or more.

A lamination factor of the soft magnetic alloy ribbon is preferably 86% or more.

A thickness of the soft magnetic alloy ribbon is preferably 25 μm or more.

A magnetic flux density of the soft magnetic alloy ribbon when a magnetic field of 80 A/m is imposed in a casting direction of the soft magnetic alloy ribbon is a magnetic flux density L, and a magnetic flux density of the soft magnetic alloy ribbon when a magnetic field of 80 A/m is imposed in a direction orthogonal to the casting direction of the soft magnetic alloy ribbon is a magnetic flux density W. A ratio (L/W) of the magnetic flux density L to the magnetic flux density W is preferably from 0.7 to 1.3.

A saturation magnetostriction of the soft magnetic alloy ribbon is preferably 20 ppm or less.

The formula preferably satisfies $83 \le a \le 86$, $0.3 \le b \le 2$, $0.4 \le d \le 0.9$, and $0 \le e \le 0.3$, and a saturation magnetic flux density of the soft magnetic alloy ribbon is preferably 1.77 T or more.

In the composition formula of the soft magnetic alloy ribbon, a part of Fe content is preferably replaced with at least one type of element selected from Co and Ni up to 6 at % at a maximum.

One aspect of the present disclosure is a method of manufacturing the soft magnetic alloy ribbon, the method including ejecting a molten alloy on a rotating chill roll, and quenching the molten alloy on the chill roll. An outer circumferential portion of the chill roll is made of a Cu alloy having a thermal conductivity of 120 W/(m·K) or more.

One aspect of the present disclosure is a method of manufacturing a soft magnetic alloy ribbon having a structure that has a crystal grain with a grain diameter of 60 nm or less in an amorphous phase, the method including an annealing process of an alloy ribbon.

In the annealing process, a temperature 10 to 140° C. less than a bccFe-crystallization starting temperature is a temperature T1, and a temperature 30 to 120° C. less than an Fe—B compound deposition starting temperature is a temperature T2.

The annealing process includes heating the alloy ribbon from a room temperature to the T1 at a heating rate of 50° C./sec or more; heating the alloy ribbon from the T1 to the T2 at a rate slower than the heating rate from the room temperature to the T1 and at a heating rate of 400° C./sec or less; cooling the alloy ribbon after reaching the T2; or retaining the alloy ribbon at a temperature between the T2 and the T2 minus 50° C. for 0.5 to 60 seconds after reaching the T2 and subsequently cooling the alloy ribbon.

Preferably, the alloy ribbon before the annealing process is obtained by ejecting a molten alloy on a rotating chill roll and quenching the molten alloy on the chill roll, and an outer circumferential portion of the chill roll is made of a Cu alloy having a thermal conductivity of 120 W/(m·K) or more.

When a density of the alloy ribbon before the annealing process is M1 and a density of the alloy ribbon after the annealing process is M2, a value of M2/M1 is preferably 1.005 or more.

Preferably, the soft magnetic alloy ribbon includes an alloy represented by a composition formula of $Fe_aSi_bB_cCu_dM_e$, M being at least one type of element selected from a group consisting of Nb, Mo, V, Zr, Hf, and W, and the formula satisfying $82.5 \le a \le 86$, $0.3 \le b \le 3$, $12.5 \le c \le 15.0$, $0.05 \le d \le 0.9$, and $0 \le e < 0.4$ in at %.

One aspect of the present disclosure is a magnetic core formed by using the soft magnetic alloy ribbon.

One aspect of the present disclosure is a component that includes the magnetic core and a coil.

Effects of the Invention

One aspect of the present disclosure can provide a soft magnetic alloy and a soft magnetic alloy ribbon with a high saturation magnetic flux density and a low iron loss. One aspect of the present disclosure can provide a soft magnetic alloy ribbon having an isotropy. A magnetic core and a component formed by using the soft magnetic alloy ribbon of one aspect of the present disclosure can possess properties of high saturation magnetic flux density and a low iron loss.

BRIEF DESCRIPTION OF THE DRAWINGS

An example embodiment of the present disclosure will be described hereinafter with reference to the accompanying drawings, in which.

DETAILED DESCRIPTION OF EXEMPLARY EMBODIMENTS

Figure 1:
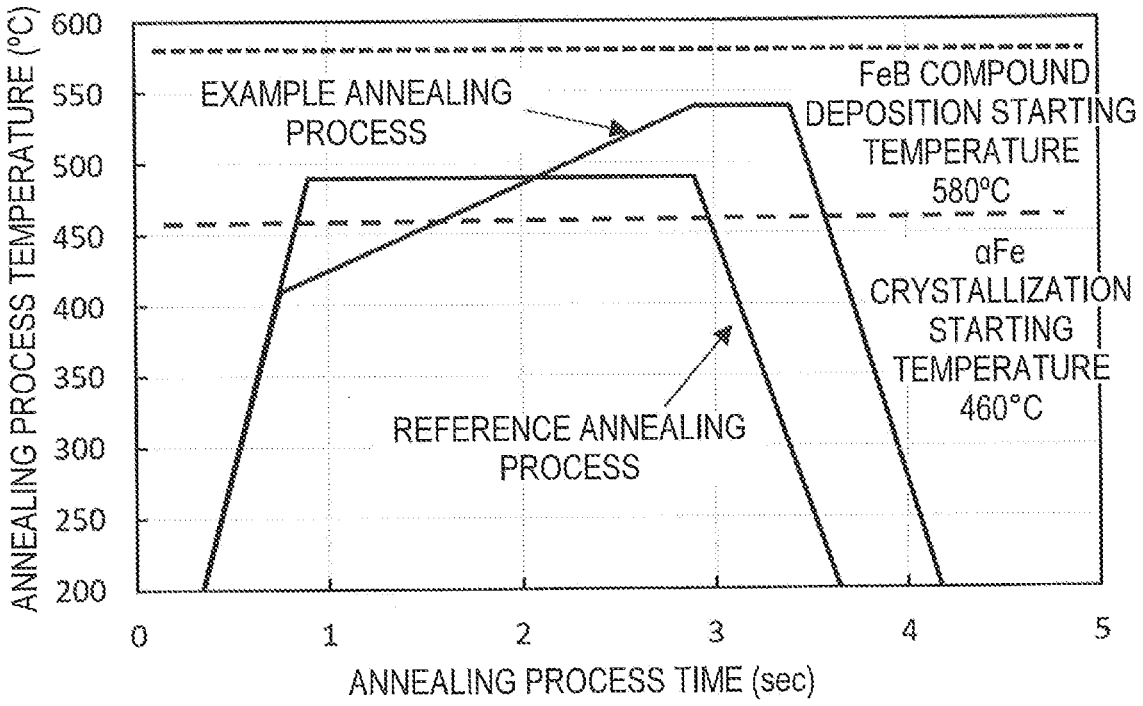
FIG. 1 is a diagram showing an example annealing process pattern of an embodiment of the present disclosure and a reference annealing process pattern of the embodiment of the present disclosure.

Hereinafter, embodiments of the present disclosure will be described in detail. The present disclosure is not limited to the embodiments described below but can be appropriately modified within a scope of the object of the present disclosure.

In the present disclosure, a range of numerical values expressed with a preposition "to" means that the range includes the numerical values written before and after the preposition "to" as a minimum value and a maximum value. In the present disclosure, in a set of ranges of numerical values written in stages, the maximum value or the minimum value included in one range of numerical values may be replaced with the maximum value or the minimum value in another range of numerical values written in stages. In the present disclosure, the maximum value or the minimum value of a range of numerical values may be replaced with a value mentioned in the embodiments.

In the present disclosure, a combination of two or more aspects is construed as more preferable aspect.

A soft magnetic alloy of the present disclosure is represented by a composition formula of $Fe_aSi_bB_cCu_dM_e$ where M is at least one type of element selected from a group consisting of Nb, Mo, V, Zr, Hf, and W, and the formula satisfies $82.5 \le a \le 86$, $0.3 \le b \le 3$, $12.5 \le c \le 15.0$, $0.05 \le d \le 0.9$, and $0 \le e < 0.4$ in at %.

The soft magnetic alloy includes a structure that has a crystal grain with a grain diameter of 60 nm or less in an amorphous phase.

The following is a detailed description of a composition of the present disclosure.

Fe (Iron) is 82.5% or More and 86% or Less in at %.

By setting a content of Fe to 82.5% or more, the alloy can satisfy a saturation magnetic flux density of 1.75 T or more. The content of Fe is preferably 83% or more, more preferably 83.5% or more, and yet more preferably 84% or more.

Amorphization of the alloy becomes difficult when the content of Fe exceeds 86%. Thus, the content of Fe is 86% or less, and preferably 85.5% or less.

Si (Silicon) is 0.3% or More and 3% or Less in at %.

By including Si, an oxide layer of $SiO_2$ with a thickness of several tens of nanometers can be formed on a surface of the soft magnetic alloy. This improves corrosion resistance of the soft magnetic alloy. To attain an effect of the improved corrosion resistance, the content of Si is 0.3% or more, and preferably 1.0% or more.

It becomes difficult to attain the saturation magnetic flux density greater than 1.75 T and to increase a thickness of a soft magnetic alloy ribbon when the content of Si exceeds 3%. Thus, the content of Si is 3% or less, preferably 2% or less, and more preferably 1.4% or less.

B (Boron) is 12.5% or More and 15.0% or Less in at %.

Amorphization of the alloy becomes difficult when the content of B is below 12.5%. Thus, the content of B is 12.5% or more, preferably 13.0% or more, and more preferably 13.5% or more.

A difference between a bccFe (αFe)-crystallization starting temperature and a Fe—B compound deposition starting temperature decreases if the content of B exceeds 15.0%, which narrows a range of optimum temperatures for an annealing process. Consequently, it becomes difficult to attain a uniform and fine nano-crystalline structure that can provide an iron loss of 25 W/kg or less at 1 T and at 1 kHz. Thus, the content of B is 15.0% or less, preferably 14.5% or less, more preferably 14.4% or less, and yet more preferably 14.0% or less.

Cu (Copper) is 0.05% or More and 0.9% or Less in at %.

It becomes difficult to attain a uniform and fine nano-crystalline structure that can provide an iron loss of 25 W/kg or less at 1 T and at 1 kHz if the content of Cu is below 0.05%. Thus, the content of Cu is 0.05% or more, preferably 0.2% or more, and more preferably 0.4% or more, and yet more preferably 0.5% or more.

The alloy becomes prone to embrittlement if the content of Cu exceeds 0.9%, which makes it difficult to increase the thickness of the soft magnetic alloy ribbon. Thus, the content of Cu is 0.9% or less, preferably 0.7% or less, and more preferably 0.6% or less.

The M element is at least one type of element selected from a group consisting of Nb, Mo, V, Zr, Hf, and W, and a content of the M element is 0 (zero) % or more and below 0.4% in at %.

The content of the M element may be 0 (zero) %, but an inclusion of the M element can bring a deposition starting temperature of Fe—B compound, which causes a significant deterioration of a magnetic property of the alloy, to a higher temperature. This can increase the difference between the bccFe (αFe)-crystallization starting temperature and the Fe—B compound deposition starting temperature and consequently increase the range of optimum temperatures for the annealing process, which, as a result, can mitigate conditions of the annealing process. The content of the M element is preferably 0.1% or more, and more preferably 0.15% or more.

Because the M element is expensive, a cost for the alloy increases as the content of the M element increases. Thus, the content of the M element is preferably small. The content of the M element is therefore below 0.4%, preferably 0.3% or less, and more preferably 0.25% or less.

In the soft magnetic alloy of the present disclosure, a part of Fe content may be replaced with at least one type of element selected from Co and Ni up to 6 at % at the maximum. The soft magnetic alloy of the present disclosure may also replace a part of the Fe content with at least one type of element selected from Co and Ni up to 5 at % at the maximum.

The soft magnetic alloy of the present disclosure may include C (carbon). The content of C is preferably 1 mass % or less.

The soft magnetic alloy of the present disclosure may include impurities besides Co, Ni, and C mentioned above, in addition to the elements represented in the composition formula of $Fe_aSi_bB_cCu_dM_e$.

The impurities include elements other than those mentioned above. For example, S (sulfur), O (oxygen), N (nitrogen), Cr, Mn, P, Ti, and Al. For example, a content of S is preferably 200 mass ppm or less; a content of 0 is preferably 5,000 mass ppm or less; and a content of N is preferably 1,000 mass ppm or less. The total content of the impurities is preferably 0.5 mass % or less. Elements corresponding to the impurities may be added as long as their contents are within the above ranges.

The soft magnetic alloy of the present disclosure includes a structure that has a crystal grain with a grain diameter of 60 nm or less in an amorphous phase. This structure, which has a crystal grain with a grain diameter of 60 nm or less in an amorphous phase, is also called a nano-crystalline structure. A crystal having a crystal grain diameter of 60 nm or less is also called a nanocrystal.

One feature of the soft magnetic alloy of the present disclosure is to include the nano-crystalline structure.

Preferably, a proportion of the nanocrystal in the soft magnetic alloy of the present disclosure is 50% or more in volume fraction. A rough proportion of the nanocrystal in the volume fraction can be calculated by, for example, observing the nanocrystal and a non-crystalline phase on a cross-section of the alloy through a transmission electron microscope (TEM). In other words, it is possible to determine whether the proportion of the nanocrystal is 50% or more from the observed image.

When observing the cross-section of the alloy, an area ratio of the crystal grain having a diameter of 60 nm or less is preferably 50% or more in a particular visual field (the particular visual field is 100%). Preferably, the soft magnetic alloy of the present disclosure includes the crystal grain having a diameter of 60 nm or less and the non-crystalline phase; the area ratio of the crystal grain having a diameter of 60 nm or less is 50% or more. The area ratio can be determined by, for example, observing the crystal grain and the non-crystalline phase on the cross-section of the alloy through transmission electron microscope (TEM).

The saturation magnetic flux density of the soft magnetic alloy of the present disclosure is preferably 1.75 T or more. It is also preferable that the saturation magnetic flux density of the soft magnetic alloy of the present disclosure is 1.77 T or more.

A density of the soft magnetic alloy of the present disclosure is preferably 7.45 g/cm$^3$ or more. This density of 7.45 g/cm$^3$ or more increases the volume fraction of the nanocrystal, and thus increases the saturation magnetic flux density.

The iron loss of this soft magnetic alloy of the present disclosure at 1 kHz and at 1 T is preferably 25 W/kg or less. It is also preferable that the iron loss of this soft magnetic alloy is 18 W/kg or less. It is also preferable that the iron loss of this soft magnetic alloy is 15 W/kg or less.

Saturation magnetostriction of the soft magnetic alloy of the present disclosure is preferably 20 ppm or less. This helps to obtain the isotropy.

The soft magnetic alloy of the present disclosure can provide a high saturation magnetic flux density and a low iron loss.

The soft magnetic alloy of the present disclosure can be made into a form of an alloy ribbon described below, a form of a pulverized powder made by pulverizing the alloy ribbon, and a form of powder produced by a method such as an atomizing method.

The soft magnetic alloy ribbon of the present disclosure can be obtained by ejecting molten alloy having the aforementioned soft magnetic alloy composition onto a rotating chill roll, rapidly quenching and solidifying the ejected molten alloy on the chill roll to produce the alloy ribbon, and then conducting the annealing process on the alloy ribbon.

The molten alloy can be produced by mixing element sources (pure iron, ferroboron, ferrosilicon, etc.) that yield the desired alloy composition, and heating the mixture in an induction heating furnace to a melting point or more.

The alloy ribbon can be obtained by ejecting the molten alloy from a nozzle that has a slit of a given shape onto the rotating chill roll and rapidly quenching and solidifying the ejected molten alloy on the chill roll. In this process, the chill roll may have an outer diameter of 350 to 1,000 mm and a width of 100 to 400 mm, and a circumferential velocity of the rotation may be 20 to 35 m/s. The chill roll preferably includes a cooling mechanism (such as a water cooling) in an inside of the chill roll to inhibit a temperature increase in an outer circumferential portion of the chill roll.

The outer circumferential portion of the chill roll preferably is made of a Cu alloy that brings thermal conductivity of the outer circumferential portion of the chill roll to 120 W/(m·K) or more. By setting the thermal conductivity of the outer circumferential portion to 120 W/(m·K) or more, a quenching speed in a process of casting the molten alloy into the alloy ribbon can be increased. This can inhibit embrittlement of the alloy ribbon and increase the thickness of the alloy ribbon. Also, by inhibiting crystallization of a surface of the molten alloy ribbon in the casting, coarsening of the crystal grain can be inhibited and thus the iron loss can be decreased in the annealing process.

The thermal conductivity of the outer circumferential portion of the chill roll is preferably 150 W/(m·K) or more, and more preferably 180 W/(m·K) or more. Particularly, when the thickness of the soft magnetic alloy ribbon is 30 μm or more, the thermal conductivity of the outer circumferential portion is preferably 150 W/(m·K) or more.

It should be noted that the outer circumferential portion of the chill roll is a portion that contacts the molten alloy. The outer circumferential portion may be as thick as about 5 to 15 mm and may include inside a structural material that retains a roller-structure.

The soft magnetic alloy ribbon having the nano-crystalline structure can be obtained by conducting the annealing process on the alloy ribbon after producing the alloy ribbon by rapidly quenching and solidifying the molten alloy on the chill roll. Preferably, the annealing process is conducted while controlling the temperature of the alloy ribbon such that the temperature increases to the bccFe (αFe)-crystallization starting temperature or more without reaching the Fe—B compound deposition starting temperature.

Generally, a conventional annealing process of an alloy ribbon has included annealing steps of heating the alloy ribbon from a room temperature to a temperature 30 to 100° C. less than the Fe—B compound deposition starting temperature at a heating rate of 10° C./sec or more and retaining the heated alloy ribbon for several seconds.

However, when processing an alloy ribbon that included reduced amount of Cu and Nb and increased amount of Fe to obtain a high saturation magnetic flux density, the difference between the bccFe (αFe)-crystallization starting temperature and the Fe—B compound deposition starting temperature is decreased, and the range of optimum annealing temperatures (maximum temperature) is substantially narrowed. This raised a problem that the annealing temperature (maximum temperature) needed to be controlled within a narrow temperature range. In addition, wide alloy ribbons manufactured in actual productions have experienced nonuniform quenching in a width direction, nonuniform thickness in the width direction, and nonuniform compositions between different lots. This raised problems that it was far more difficult to control the annealing temperature within a narrow temperature range and to conduct a uniform annealing process.

In the annealing process of the alloy ribbon of the present disclosure, a temperature 10 to 140° C. less than the bccFe (αFe)-crystallization starting temperature is T1, and a temperature 30 to 120° C. less than the Fe—B compound deposition starting temperature is T2. Preferably, the alloy ribbon is heated from the room temperature to T1 at a heating rate of 50° C./sec or more and heated from T1 to T2 at a heating rate of 400° C./sec or less and slower than the heating rate from the room temperature to T1, and then cooled. The alloy ribbon may be cooled directly after reaching T2, or may be retained at a temperature between T2 and T2 minus 50° C. for 0.5 to 60 seconds after reaching T2, and then cooled. T1 may be 10 to 120° C. less than the bccFe (αFe)-crystallization starting temperature. T2 may be 10 to 120° C. less than the Fe—B compound deposition starting temperature or 10 to 100° C. less than the Fe—B compound deposition starting temperature.

Note that the heating rate is an average heating rate between the given temperature range. For example, the heating rate from the room temperature to T1 can be calculated by a division with a time (seconds) taken to reach T1 from the room temperature being a denominator, and a temperature obtained by deducting the room temperature (25° C.) from T1 being a numerator.

An annealing method of the alloy ribbon of the present disclosure can stably produce the soft magnetic alloy ribbon having a high saturation magnetic flux density and a low iron loss.

The annealing process of the alloy ribbon of the present disclosure can be conducted after processing the alloy ribbon into a magnetic core shape. Examples of the magnetic core shape include a magnetic core that is formed by processing the alloy ribbon into a shape of magnetic core by pressing or the like, a magnetic core that is formed by laminating thus processed core-shaped ribbons, and a wound magnetic core that is formed by winding the alloy ribbon.

Figure 2:
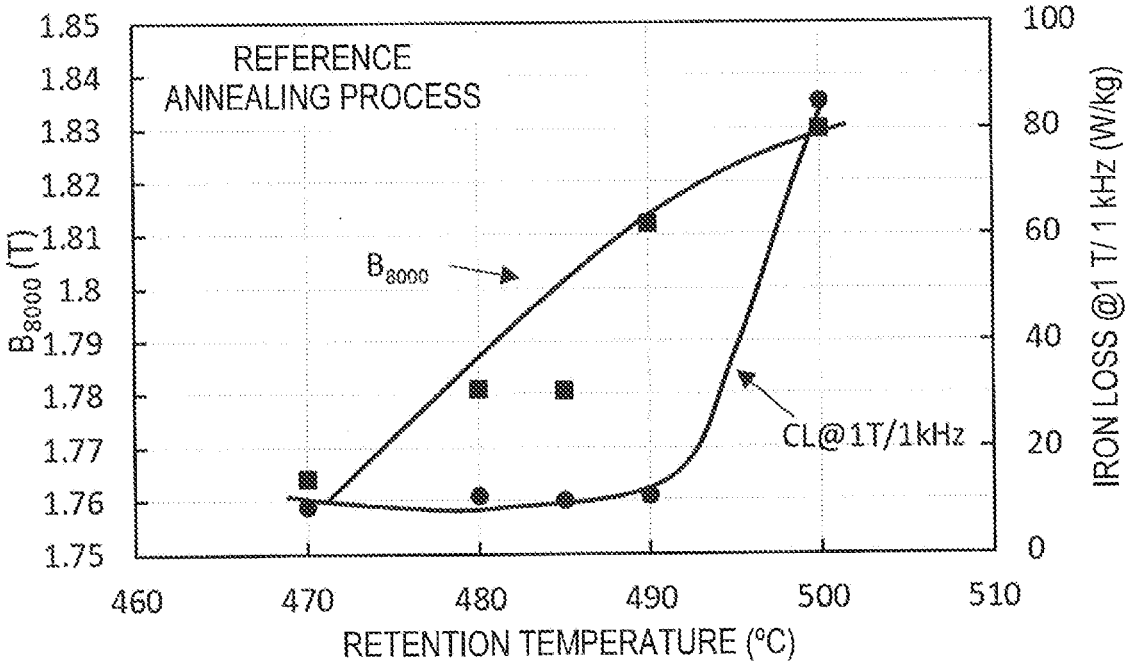
FIG. 2 is a diagram showing a correlation between a retention temperature, $B_{8000}$, and an iron loss of samples that are thermally processed with reference annealing process patterns.

FIG. 1 shows an example annealing process pattern of one embodiment of the present disclosure and a reference annealing process pattern of the embodiment. FIG. 2 (reference annealing process patterns) and FIG. 3 (example annealing process patterns) show correlations between the retention temperatures in the annealing process patterns (X-axis), the magnetic flux density $B_{8000}$ when imposing a magnetic field of 8,000 A/m (Y-axis), and the iron loss (CL) at 1 T and at 1 kHz (Y-axis). Table 1 (reference annealing process patterns) and Table 2 (example annealing process patterns) show the conditions of annealing process, and values of $B_{8000}$ and the iron loss in each of the annealing process patterns. The alloy composition of the obtained sample is the same as the alloy composition of No. 3 in Table 3, which will be explained later. The obtained sample had the bccFe (αFe)-crystallization starting temperature of 460° C., and the Fe—B compound deposition starting temperature of 580° C.

As shown in FIG. 2 and Table 1, in the reference annealing process patterns C1 to C5 of the present disclosure, $B_{8000}$ gradually increased from 1.76 T to 1.83 T as the retention temperature increased from 470° C. to 500° C. The iron loss at the retention temperature of 500° C. was significantly high compared to the iron loss when the retention temperature was from 470° C. to 490° C. The iron loss sharply increased at or above the retention temperature when $B_{8000}$ exceeded 1.82 T, which exceedingly narrowed the temperature range where a high saturation magnetic flux density and a low iron loss could be well balanced.

Figure 3:
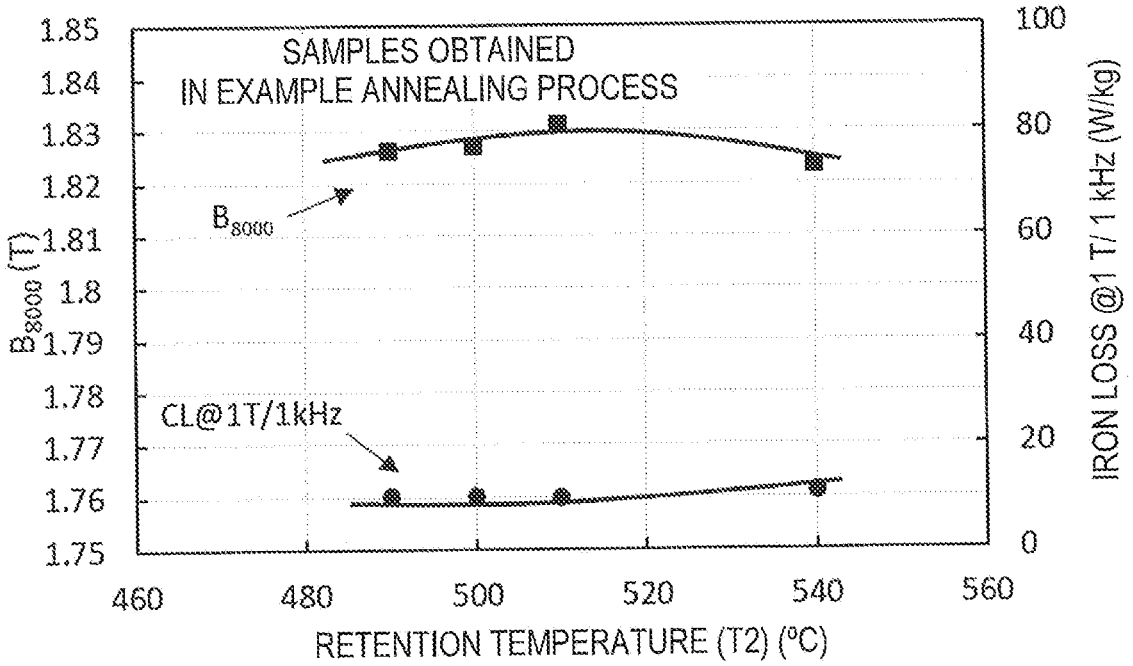
FIG. 3 is a diagram showing a correlation between a retention temperature, $B_{8000}$, and an iron loss of samples that are thermally processed with example annealing process patterns.

Meanwhile, as shown in FIG. 3 and Table 2, in the example annealing process patterns E1 to E4 of the present disclosure, T1 of each of E1, E2, E3, and E4 was lower than the bccFe (αFe)-crystallization starting temperature (460° C.) by 100° C., 90° C., 80° C., and 50° C., respectively, and T2 of each of E1, E2, E3, and E4 was lower than the Fe—B compound deposition starting temperature (580° C.) by 90° C., 80° C., 70° C., and 40° C., respectively. A T1 retention time in E1 to E4 was 0 (zero) seconds. A T2 retention time in E1 to E4 was 0.5 seconds.

In the example annealing process patterns of E1 to E4, when the retention temperature of T2 was from 490 to 540° C., $B_{8000}$ was high at 1.82 to 1.83 T and almost stable, and the iron loss was also almost stable between 9.8 and 11 W/kg. This suggested that E1 to E4 provide the retention temperature ranging 50° C. or more, at which $B_{8000}$ exceeds 1.82 T and the iron loss was 25 W/kg or less, and thus can stably provide a high saturation magnetic flux density and a low iron loss. The samples obtained in the example annealing process patterns of the present disclosure had a structure that has a crystal grain with a grain diameter of 60 nm or less in an amorphous phase. In addition, in an observation of a cross-section of each sample, the area ratio of the crystal grain having a diameter of 60 nm or less was 50% or more (the observed field is 100%). In FIG. 3 and Table 2, the retention temperature was T2.

TABLE 1

| | Retaining Temperature (° C.) | Heating Rate (° C./sec) | Retaining Time (sec) | $B_{8000}$ (T) | Iron Loss @1T/ 1kHz(W/kg) |
|---|---|---|---|---|---|
| C1 | 470 | 490 | 2 | 1.76 | 9 |
| C2 | 480 | 500 | 2 | 1.78 | 11 |
| C3 | 485 | 510 | 2 | 1.78 | 10 |
| C4 | 490 | 515 | 2 | 1.81 | 11 |
| C5 | 500 | 525 | 2 | 1.83 | 85 |

TABLE 2

| | T1 (° C.) | Heating Rate to T1 (° C./ sec) | T2 (° C.) | T1-T2 Heating Rate (° C./ sec) | Re-taining Time (sec) | $B_{8000}$ (T) | Iron Loss @1T/ 1 kHz (W/kg) |
|---|---|---|---|---|---|---|---|
| E1 | 360 | 400 | 490 | 60 | 0.5 | 1.83 | 10.3 |
| E2 | 370 | 410 | 500 | 60 | 0.5 | 1.83 | 10.1 |
| E3 | 380 | 420 | 510 | 60 | 0.5 | 1.83 | 9.8 |
| E4 | 410 | 450 | 540 | 60 | 0.5 | 1.82 | 11 |

Preferably, the heating rate in the annealing process is fast in view of the productivity of the alloy ribbon, nuclear density to obtain, and reduction of coarsening of the crystal grain diameter. However, crystallization occurs in a short time if the heating rate is too fast, which increases heating value per hour and brings the temperature of the alloy ribbon excessively high to reach the Fe—B compound deposition starting temperature, and results in inducing deposition of Fe—B compound. In a case in which the temperature of the alloy ribbon is increased but not reaching the Fe—B compound deposition starting temperature, the growth of the crystal grain is still accelerated, and the iron loss is increased.

Thus, in the annealing process of the present disclosure, the heating rate from T1 (first temperature) is reduced to inhibit deposition of Fe—B compound. In addition, the growth of crystals is inhibited by reducing the heating rate to enable reduction of nonuniformity in the crystals. This enables an improvement in reducing iron loss and reducing defects in shapes caused in the annealing process, such as creases produced due to shrinkage differences.

The heating rate from the room temperature to T1 may be determined based on the capacity of the equipment, but the faster the better, for example, 50° C./sec or more. The heating rate is preferably 200° C./sec or more, more preferably 300° C./sec or more, and yet more preferably 400° C./sec or more.

The heating rate from T1 to T2 is 400° C./sec or less, preferably 200° C./sec or less, more preferably 150° C./sec or less, yet more preferably 100° C./sec or less. The heating rate from T1 to T2 is preferably 10° C./sec or more, more preferably 30° C./sec or more, yet more preferably 50° C./sec or more.

When the heating rate from the room temperature to T1 is 200° C./sec or more, the heating rate from T1 to T2 is below 200° C./sec, preferably 150° C./sec or less, and more preferably 100° C./sec or less.

When the heating rate from T1 to T2 is 300° C./sec or more, the heating rate from T1 to T2 is below 300° C./sec, preferably 200° C./sec or less, more preferably 150° C./sec or less, and the most preferably 100° C./sec or less.

As mentioned above, the annealing process of the soft magnetic alloy ribbon of the present disclosure is conducted at a fast heating rate, which is up to T1 (a given temperature lower than a temperature where the temperature increase due to crystallization of bccFe (αFe) starts). In addition, the heating rate after passing T1 is set lower than the heating rate before reaching T1 and also 400° C./sec or less. Heat generation due to crystallization is therefore controlled, which then inhibits deposition of Fe—B compound and a grain growth of αFe crystals.

The soft magnetic alloy ribbon of the present disclosure can accordingly (i) provide an increase in the temperature range of the annealing process where a high saturation magnetic flux density and a low iron loss can be obtained, (ii) an increase in the temperature range to control, and (iii) provide an excellent annealing processability by the annealing method of the present disclosure.

When a density of the soft magnetic alloy ribbon of the present disclosure before the annealing process is M1 and a density of the soft magnetic alloy ribbon of the present disclosure after the annealing process is M2, a value of M2/M1 is preferably 1.005 or more. The aforementioned annealing method of the present disclosure can improve the density of the alloy ribbon. Therefore, a high saturation magnetic flux density can be attained.

The soft magnetic alloy ribbon of the present disclosure has a high saturation magnetic flux density and a low iron loss. An attainable high saturation magnetic flux density is 1.75 T or more, and an attainable iron loss is 25 W/kg or less at 1 kHz and at 1 T. Such an iron loss is preferably 18 W/kg or less.

The density of the soft magnetic alloy ribbon of the present disclosure is preferably 7.45 g/cm$^3$ or more. Such a density of 7.45 g/cm$^3$ or more increases volume fraction of the nanocrystal and increases the saturation magnetic flux density.

The saturation magnetic flux density of the soft magnetic alloy ribbon of the present disclosure is preferably 1.77 T or more.

The iron loss of the soft magnetic alloy ribbon of the present disclosure at 1 kHz and at 1 T is preferably 15 W/kg or less.

A saturation magnetostriction of the soft magnetic alloy ribbon of the present disclosure is preferably 20 ppm or less. This helps to obtain the isotropy.

The soft magnetic alloy ribbon of the present disclosure has the soft magnetic alloy structure and features as mentioned above. To avoid redundancy, the aforementioned descriptions of the soft magnetic alloy structure and features apply hereinafter.

The thickness of the soft magnetic alloy ribbon of the present disclosure is preferably 15 μm or more, more preferably 20 μm or more, yet more preferably 25 μm or more, and yet more preferably 30 μm or more. For example, the thickness of 25 μm or more can reduce man-hour and manufacturing cost for manufacturing the magnetic core by laminating the soft magnetic alloy ribbons. The thickness is more preferably 32 μm or more. In addition, as the thickness of the soft magnetic alloy ribbon increases, the manufacture of the alloy ribbon becomes difficult. Thus, the thickness is preferably 50 μm or less, and more preferably 35 μm or less.

In an application in which the iron loss needs to be lower in a high frequency over 1 kHz, the soft magnetic alloy ribbon having a thickness of about 15 to 25 μm is preferable.

The soft magnetic alloy ribbon of the present disclosure also provides a high lamination factor. The lamination factor of the soft magnetic alloy ribbon of the present disclosure may be 86% or more. The lamination factor of the soft magnetic alloy ribbon of the present disclosure is preferably 88% or more, and more preferably 90% or more. When laminating the soft magnetic alloy ribbons, a high lamination factor enables a thin laminate thickness with the same number of laminates compared to alloy ribbons with a low lamination factor. This contributes to downsizing of the magnetic core and the component.

The lamination factor can be measured by the following method in accordance with JIS C 2534: 2017.

20 ribbons each cut in the length of 120 mm are laminated on one another and the laminated ribbons are placed on a flat sample stand. A flat anvil having a diameter of 16 mm is placed on the laminated ribbons at a pressure of 50 kPa. The height of the laminated ribbons is measured at every 10 mm in a width direction. The maximum height in the measurement is hmax (μm). The lamination factor LF is calculated from the following equation.

$$LF\ (\%) = \text{weight of sample (g)}/\text{density (g/cm}^3)/h\text{max (μm)}/\text{sample length (240 cm)}/\text{ribbon width (cm)} \times 10{,}000$$

The density (g/cm$^3$) in this equation is the density of the alloy ribbon after the annealing process.

A magnetic flux density of the soft magnetic alloy ribbon when the magnetic field of 80 A/m is imposed in a casting direction of the soft magnetic alloy ribbon is a magnetic flux density L. A magnetic flux density of the soft magnetic alloy ribbon when the magnetic field of 80 A/m is imposed in a direction orthogonal to the casting direction of the soft magnetic alloy ribbon is a magnetic flux density W. Preferably, a ratio (L/W) of the magnetic flux density L to the magnetic flux density W of the soft magnetic alloy ribbon of the present disclosure is from 0.7 to 1.3. The soft magnetic alloy ribbon which is highly isotropic can be obtained by having this ratio (L/W) to be 0.7 to 1.3.

In general, an alloy ribbon as mentioned above that is manufactured by an ejection of molten alloy on a rotating chill roll followed by rapid quenching and solidification obtains an anisotropy in the casting direction. The casting direction is a direction along a rotation direction of the chill roll, which is also a longitudinal direction of continuously casted alloy ribbons.

As mentioned above, the anisotropy in the casting direction of the soft magnetic alloy ribbons, which is obtained during the casting, also affects the property of the soft magnetic alloy ribbon after the annealing process (after the annealing process to produce the nano-crystalline structure). Particularly, if the volume fraction of the non-crystalline phase is high, a difference is caused between the magnetic flux density in the casting direction of the soft magnetic alloy ribbon (the longitudinal direction) and the magnetic flux density in the direction orthogonal to the casting direction of the soft magnetic alloy ribbon (a direction orthogonal to the longitudinal direction and corresponding to the width direction), which results in keeping the anisotropy after the annealing process.

However, some applications of the soft magnetic alloy ribbon, such as an application in a motor, require isotropy of the soft magnetic alloy ribbons. Thus, it is preferable to conduct the annealing process such that the volume fraction of the crystals is increased to keep the difference in the magnetic flux density in the soft magnetic alloy ribbon between the casting direction and the direction orthogonal to the casting direction within a given range.

Meanwhile, if a temperature is raised or a time for annealing process is prolonged to increase the volume fraction of the nanocrystal, the Fe—B compound deposits in certain conditions, which deteriorates the magnetic property of the alloy ribbon. Particularly, the soft magnetic alloy ribbon with a high content of Fe has a narrow temperature range of the annealing process to become isotropic. This has raised a problem that it is difficult to obtain the soft magnetic alloy ribbon with the nano-crystalline structure that has all of a high saturation magnetic flux density, a low iron loss, and isotropy.

The present disclosure can solve the above problem and provide the soft magnetic alloy ribbon that has both a high saturation magnetic flux density and a low iron loss and further has the isotropy while inhibiting the deposition of the Fe—B compound.

The soft magnetic alloy ribbon of the present disclosure has a wide acceptable range of the annealing temperature in the annealing process to obtain desired properties. Thus, mass productivity of the soft magnetic alloy ribbon is still high even with a consideration of nonuniformity generated in a mass production. Particularly, a wide alloy ribbon used in applications, such as a magnetic core for motors, is liable to temperature nonuniformity during the annealing process. Therefore, it is effective to have a wide acceptable range of the annealing temperature in the annealing process.

In general, when nonuniformity in the heating rate or in the temperature in the alloy ribbon occurs, the heat generation due to crystallization becomes partially uncontrollable. This causes nonuniformity in shrinkage during the crystallization and results in forming creases and the like on the alloy ribbon, which likely produces defects such as a decrease in the lamination factor when the magnetic core is formed.

However, as mentioned above, the soft magnetic alloy ribbon of the present disclosure has a wide acceptance range to allow the temperature nonuniformity during the annealing process. Therefore, the soft magnetic alloy ribbon with reduced creases, a high lamination factor, and a high smoothness can be obtained.

The smoothness can be defined by a calculation of (hmax−hmin)/20, using the maximum thickness hmax and the minimum thickness hmin of the thicknesses in the width direction measured when determining the lamination factor. The smoothness is preferably 4 μm or less, and more preferably 3 μm or less.

Using the soft magnetic alloy ribbon of the present disclosure, the magnetic core with excellent properties for uses in transformers, electronic components, motors, and the like can be obtained.

The magnetic core is formed by the processes such as, cutting the alloy ribbon into a given shape, laminating the cut alloy ribbons, winding the alloy ribbons, and bending the laminated alloy ribbons.

The magnetic core can also be formed by using powdered materials produced by pulverizing the soft magnetic alloy ribbon of the present disclosure. The magnetic core can also be formed by using a powder-form of the soft magnetic alloy of the present disclosure that is formed by the atomizing method.

A component of transformers, electronic components, motors, and the like with excellent properties can be obtained by combining the magnetic core of the present disclosure and a coil. The magnetic core of the present disclosure may also be combined with a magnetic core made of other magnetic materials.

EMBODIMENTS

First Embodiment

Element sources were mixed to create compositions shown in Table 3. Each composition was heated to 1,300° C. to produce a molten alloy. Each molten alloy was ejected on a chill roll with an outer diameter of 400 mm and a width of 200 mm and rotated at a circumferential velocity of 30 m/s. The ejected molten alloy was rapidly quenched and solidified on the chill roll to produce an alloy ribbon. An annealing process was conducted on each alloy ribbon under the conditions of annealing process shown in Table 4 to produce a soft magnetic alloy ribbon having a nano-crystalline structure. A width and thickness of each produced alloy ribbon are shown in Table 4. An outer circumferential portion of the chill roll as made of a Cu alloy having a thermal conductivity of 150 W/(m·K), the chill roll includes a cooling mechanism inside to control the temperature of the outer circumferential portion.

In Tables 3 and 4, samples No. 1 to 6, and No. 10 to 23 are examples of the soft magnetic alloy ribbons of the present disclosure, and samples No. 51 to 53 are reference examples of the soft magnetic alloy ribbons of the present disclosure. Table 4 shows $B_{8000}$, the iron loss at 1 T/1 kHz, the density, the bccFe (αFe)-crystallization starting temperature, the Fe—B compound deposition starting temperature, T1, T2, the heating rate from the room temperature to T1, and the heating rate from T1 to T2 for each sample. The heating rate from the room temperature to T1 was set at 400 to 500° C./sec. The density was measured after the annealing process.

The samples No. 1 to 6, and No. 10 to 23 each had a structure having a crystal grain with a grain diameter of 60 nm or less in an amorphous phase. In an observation of a cross-section of each sample, an area ratio of the crystal grain having a diameter of 60 nm or less was 50% or more (the observed field was 100%).

[BccFe (αFe)-Crystallization Starting Temperature/Fe—B Compound Deposition Starting Temperature]

The bccFe (αFe)-crystallization starting temperature and the Fe—B compound deposition starting temperature vary depending on the heating rate. However, a typical thermal analysis instrument has an upper limit of the heating rate of about 2° C./sec, and thus is not capable of measuring the heating rate in the annealing process of the present disclosure. Therefore, the following method was used for measurements at the heating rate of 50° C./sec to determine the bccFe (αFe)-crystallization starting temperature and the Fe—B compound deposition starting temperature.

A DSC8231, a product of Rigaku Corporation, was used to measure the bccFe (αFe)-crystallization starting temperature and the Fe—B compound deposition starting temperature at three heating rates, 5° C./min (0.083° C./sec), 20° C./min (0.333° C./sec), and 50° C./min (0.833° C./sec). The measured values were plotted with a logarithm of the heating rate on X-axis, and with the bccFe (αFe)-crystallization starting temperature or the Fe—B compound deposition starting temperature on Y-axis. The value at the heating rate of 50° C./sec was obtained by extrapolating the measured values on an approximated curve of the plot.

The soft magnetic alloy ribbon after the annealing process was used to measure the saturation magnetic flux density ($B_{8000}$), the iron loss, and the density.

[Saturation Magnetic Flux Density ($B_{8000}$)]

A DC magnetization property testing instrument, a product of Metron Technology Research Co., Ltd., was used to impose a magnetic field of 8,000 A/m on the soft magnetic alloy ribbon (single-plate sample) after the annealing process to measure a maximum magnetic flux density at a given moment, which was $B_{8000}$. Because the soft magnetic alloy ribbon of the present disclosure has a property of being relatively liable to saturate, the soft magnetic alloy ribbon had saturated when the magnetic field of 8,000 A/m was imposed, which makes the value of $B_{8000}$ and the value of the saturation magnetic flux density approximately the same. Therefore, the saturation magnetic flux density is expressed as $B_{8000}$.

[Iron Loss]

An AC magnetism measurement equipment TWM18SR, a product of Toei Industry Co., Ltd., was used to measure the iron loss of the soft magnetic alloy ribbon (single-plate sample) after the annealing process under the conditions of the magnetic flux density of 1 T and the frequency of 1 kHz.

[Density]

A core-shaped sample, which was sized to allow an insertion into a column sample cell with a diameter of 17 mm and a height of 33 mm, was produced by a fixed volume expansion method, and the volume of the core-shaped sample was measured. A dry-process pycnometer AccuPyc1330, a product of Shimadzu Corporation, was used to measure the density of the core-shaped sample by dividing its weight by its volume.

The density of the alloy ribbon before the annealing process is M1; the density of the alloy ribbon after the annealing process is M2.

TABLE 3

| | Composition (at%) | | | | | | | | | | |
|---|---|---|---|---|---|---|---|---|---|---|---|
| No. | Fe | Co | Ni | Si | B | Cu | Nb | Mo | V | Hf | W |
| 1 | 83.58 | — | — | 1.92 | 13.29 | 0.83 | — | 0.38 | — | — | — |
| 2 | 85.72 | — | — | 0.35 | 13.53 | 0.20 | 0.20 | — | — | — | — |
| 3 | 85.34 | — | — | 0.32 | 13.62 | 0.52 | 0.20 | — | — | — | — |
| 4 | 84.08 | — | — | 1.00 | 14.52 | 0.30 | 0.10 | — | — | — | — |
| 5 | 84.87 | — | — | 0.30 | 14.43 | 0.20 | 0.20 | — | — | — | — |
| 6 | 84.20 | — | — | 0.70 | 14.20 | 0.70 | 0.20 | — | — | — | — |
| 10 | 84.80 | — | — | 0.40 | 14.10 | 0.50 | 0.20 | — | — | — | — |
| 11 | 83.80 | 1.10 | — | 0.40 | 14.00 | 0.50 | 0.20 | — | — | — | — |
| 12 | 79.40 | 5.40 | — | 0.40 | 14.10 | 0.50 | 0.20 | — | — | — | — |
| 13 | 83.90 | — | 1.00 | 0.40 | 14.00 | 0.50 | 0.20 | — | — | — | — |
| 14 | 81.90 | — | 3.00 | 0.40 | 14.00 | 0.50 | 0.20 | — | — | — | — |
| 15 | 79.90 | — | 5.00 | 0.40 | 14.00 | 0.50 | 0.20 | — | — | — | — |
| 16 | 84.90 | — | — | 0.40 | 14.00 | 0.50 | — | 0.20 | — | — | — |
| 17 | 84.90 | — | — | 0.40 | 14.00 | 0.50 | — | — | 0.20 | — | — |
| 18 | 84.80 | — | — | 0.40 | 14.10 | 0.50 | — | — | — | 0.20 | — |
| 19 | 84.90 | — | — | 0.40 | 14.00 | 0.50 | — | — | — | — | 0.20 |
| 20 | 83.50 | — | 1.50 | 0.40 | 14.00 | 0.60 | — | — | — | — | — |
| 21 | 83.80 | — | 1.50 | 0.40 | 14.10 | 0.20 | — | — | — | — | — |
| 22 | 85.15 | — | — | 0.30 | 14.10 | 0.40 | 0.05 | — | — | — | — |
| 23 | 85.18 | — | — | 0.30 | 14.30 | 0.20 | 0.02 | — | — | — | — |
| 51 | 81.60 | — | — | 3.72 | 13.64 | 0.85 | — | 0.19 | — | — | — |
| 52 | 82.68 | — | — | 1.99 | 14.18 | 0.71 | 0.44 | — | — | — | — |
| 53 | 85.96 | — | — | 0.16 | 13.85 | 0.02 | 0.01 | — | — | — | — |

TABLE 4

| No. | Width (mm) | Thickness (μm) | $B_{8000}$ (T) | Iron Loss @1T/1 kHz (W/kg) | Density (g/cm3) | bccFe-Crystallization Starting Temperature (° C.) | Fe-B Deposition Starting Temperature (° C.) | T1 (° C.) | T2 (° C.) | Heating Rate from Room Temperature to T1 (° C./sec) | Heating Rate from T1 to T2 (° C./sec) |
|---|---|---|---|---|---|---|---|---|---|---|---|
| 1 | 50 | 30 | 1.75 | 4.4 | 7.51 | 500 | 600 | 410 | 540 | 450 | 60 |
| 2 | 50 | 31 | 1.83 | 16.6 | 7.53 | 460 | 580 | 360 | 490 | 400 | 90 |
| 3 | 50 | 32 | 1.83 | 9.8 | 7.53 | 460 | 580 | 380 | 510 | 420 | 90 |
| 4 | 50 | 31 | 1.81 | 8.2 | 7.51 | 480 | 540 | 360 | 490 | 400 | 60 |
| 5 | 50 | 31 | 1.83 | 9.5 | 7.51 | 490 | 550 | 370 | 500 | 410 | 60 |
| 6 | 50 | 30 | 1.81 | 8.0 | 7.51 | 500 | 600 | 390 | 520 | 430 | 60 |
| 10 | 10 | 19 | 1.85 | 7.4 | 7.49 | 480 | 580 | 410 | 500 | 450 | 90 |
| 11 | 10 | 21 | 1.84 | 6.0 | 7.47 | 470 | 590 | 410 | 500 | 450 | 20 |
| 12 | 10 | 22 | 1.87 | 11.6 | 7.47 | 460 | 590 | 410 | 500 | 450 | 45 |
| 13 | 10 | 21 | 1.84 | 5.8 | 7.45 | 470 | 580 | 420 | 510 | 460 | 45 |
| 14 | 10 | 21 | 1.81 | 6.0 | 7.50 | 470 | 580 | 410 | 500 | 450 | 45 |
| 15 | 10 | 22 | 1.79 | 5.2 | 7.47 | 460 | 580 | 420 | 510 | 460 | 45 |
| 16 | 10 | 19 | 1.87 | 6.5 | 7.55 | 470 | 580 | 420 | 510 | 460 | 90 |
| 17 | 10 | 20 | 1.88 | 7.8 | 7.54 | 470 | 580 | 410 | 500 | 450 | 90 |
| 18 | 10 | 18 | 1.76 | 6.1 | 7.54 | 470 | 580 | 420 | 510 | 460 | 90 |
| 19 | 10 | 20 | 1.83 | 9.8 | 7.57 | 470 | 580 | 400 | 490 | 440 | 90 |
| 20 | 50 | 29 | 1.83 | 7.5 | 7.54 | 460 | 580 | 400 | 490 | 440 | 40 |
| 21 | 50 | 29 | 1.83 | 7.8 | 7.53 | 470 | 580 | 400 | 490 | 440 | 40 |

TABLE 4-continued

| No. | Width (mm) | Thickness (μm) | $B_{8000}$ (T) | Iron Loss @1T/1 kHz (W/kg) | Density (g/cm3) | bccFe-Crystallization Starting Temperature (° C.) | Fe-B Deposition Starting Temperature (° C.) | T1 (° C.) | T2 (° C.) | Heating Rate from Room Temperature to T1 (° C./sec) | Heating Rate from T1 to T2 (° C./sec) |
|---|---|---|---|---|---|---|---|---|---|---|---|
| 22 | 50 | 29 | 1.85 | 9.2 | 7.55 | 470 | 570 | 400 | 490 | 440 | 40 |
| 23 | 50 | 25 | 1.86 | 8.3 | 7.56 | 480 | 580 | 420 | 510 | 460 | 40 |
| 51 | 50 | 24 | 1.73 | 6.7 | 7.42 | 530 | 610 | 410 | 540 | 450 | 60 |
| 52 | 50 | 28 | 1.74 | 7.0 | 7.48 | 520 | 610 | 430 | 560 | 470 | 60 |
| 53 | 50 | 32 | 1.85 | 19.0 | 7.53 | 470 | 570 | 370 | 500 | 410 | 130 |

In the examples of the present disclosure (No. 1 to 6, and 10 to 23), high saturation magnetic flux densities and low iron losses were obtained. The density was 7.45 g/cm$^3$ or more.

The reference examples No. 51 and 52 had low saturation magnetic flux densities.

The reference example No. 53 had a slightly high iron loss, but its property values were the almost the same as those of the examples. However, due to a small amount of Si content, the sample of No. 53 rusted after several days of storing in the atmosphere, raising a problem in handling the samples.

Table 5 shows the ratio (L/W) and the value M2/M1 for the samples No. 1 to 6, No. 20 to 22, and No. 51 to 53. The L is a magnetic flux density of the soft magnetic alloy ribbon (single-plate sample) when the magnetic field of 80 A/m was imposed in the casting direction of the soft magnetic alloy ribbon. The W is a magnetic flux density of the soft magnetic alloy ribbon when the magnetic field of 80 A/m was imposed in the direction orthogonal to the casting direction of the soft magnetic alloy ribbon. The M1 is a density of the alloy ribbon before the annealing process; the M2 is a density of the alloy ribbon after the annealing process.

[Magnetic Flux Densities L and W]

The DC magnetization property testing instrument, a product of Metron Technology Research Co., Ltd., was used to impose a magnetic field of 80 A/m both in the casting direction and the direction orthogonal to the casting direction of the soft magnetic alloy ribbon (single-plate sample) after the annealing process; the magnetic flux densities of both directions were L and W respectively; and the isotropy was evaluated by using the ratio of L to W (L/W).

In the examples of the present disclosure (No. 1 to 6, and 20 to 22), the ratios (L/W) were within a range of 0.7 to 1.3. The obtained soft magnetic alloy ribbon had high isotropies, and density ratio (M2/M1) of 1.005 or more.

The samples No. 51 and 53 had the ratio (L/W) exceeding 1.3.

TABLE 5

| | Composition (at %) | | | | | | | | |
|---|---|---|---|---|---|---|---|---|---|
| No. | Fe | Ni | Si | B | Cu | Nb | Mo | L/W | M2/M1 |
| 1 | 83.58 | — | 1.92 | 13.29 | 0.83 | — | 0.38 | 0.80 | 1.008 |
| 2 | 85.72 | — | 0.35 | 13.53 | 0.20 | 0.20 | — | 1.11 | 1.008 |
| 3 | 85.34 | — | 0.32 | 13.62 | 0.52 | 0.20 | — | 1.10 | 1.009 |
| 4 | 84.08 | — | 1.00 | 14.52 | 0.30 | 0.10 | — | 0.94 | 1.007 |
| 5 | 84.87 | — | 0.30 | 14.43 | 0.20 | 0.20 | — | 0.99 | 1.007 |
| 6 | 84.20 | — | 0.70 | 14.20 | 0.70 | 0.20 | — | 1.20 | 1.007 |
| 20 | 83.50 | 1.50 | 0.40 | 14.00 | 0.60 | — | — | 0.90 | 1.011 |
| 21 | 83.80 | 1.50 | 0.40 | 14.10 | 0.20 | — | — | 0.78 | 1.013 |
| 22 | 85.15 | — | 0.30 | 14.10 | 0.40 | 0.05 | — | 0.84 | 1.013 |
| 51 | 81.60 | — | 3.72 | 13.64 | 0.85 | — | 0.19 | 1.36 | 1.012 |
| 52 | 82.68 | — | 1.99 | 14.18 | 0.71 | 0.44 | — | 1.20 | 1.007 |
| 53 | 85.96 | — | 0.16 | 13.85 | 0.02 | 0.01 | — | 1.41 | 1.007 |

Table 6 shows the values of the saturation magnetostrictions of the samples No. 1 to 4, 12, 15, and 20 to 23.

[Saturation Magnetostriction]

A strain gauge, a product of Kyowa Electronic Instruments Co., Ltd., was attached to the samples and a magnetic field with 5 kOe was imposed on the samples with an electromagnet. Maximum amount of changes in elongations and shrinkages of the samples, caused when the electromagnet was turned 360 degrees to change the direction of the magnetic field imposed on the samples by 360 degrees, was measured from changes in electrical resistance values indicated on the strain gauge. The saturation magnetostriction equals to ⅔×maximum amount of change.

The saturation magnetostrictions of the examples of the present disclosure (No. 1 to 4, 12, 15, and 20 to 23) were 20 ppm or less.

TABLE 6

| | Composition (at %) | | | | | | | | Saturation Magnetostriction |
|---|---|---|---|---|---|---|---|---|---|
| No. | Fe | Co | Ni | Si | B | Cu | Nb | Mo | (ppm) |
| 1 | 83.58 | — | — | 1.92 | 13.29 | 0.83 | — | 0.38 | 13.7 |
| 2 | 85.72 | — | — | 0.35 | 13.53 | 0.20 | 0.20 | — | 12.1 |
| 3 | 85.34 | — | — | 0.32 | 13.62 | 0.52 | 0.20 | — | 12.5 |
| 4 | 84.08 | — | — | 1.00 | 14.52 | 0.30 | 0.10 | — | 15.7 |
| 12 | 79.40 | 5.40 | — | 0.40 | 14.10 | 0.50 | 0.20 | — | 17.8 |
| 15 | 79.90 | — | 5.00 | 0.40 | 14.00 | 0.50 | 0.20 | — | 16.9 |
| 20 | 83.50 | — | 1.50 | 0.40 | 14.00 | 0.60 | — | — | 18.8 |
| 21 | 83.80 | — | 1.50 | 0.40 | 14.10 | 0.20 | — | — | 18.1 |

TABLE 6-continued

| No. | Composition (at %) Fe | Co | Ni | Si | B | Cu | Nb | Mo | Saturation Magnetostriction (ppm) |
|---|---|---|---|---|---|---|---|---|---|
| 22 | 85.15 | — | — | 0.30 | 14.10 | 0.40 | 0.05 | — | 14.9 |
| 23 | 85.18 | — | — | 0.30 | 14.30 | 0.20 | 0.02 | — | 14.0 |

Second Embodiment

Element sources were mixed to create a composition represented by a formula of $Fe_{82.93}Si_{2.30}B_{13.70}Nb_{0.38}Cu_{0.69}$. The composition was heated to 1,300° C. into a molten alloy. The molten alloy was ejected on a chill roll with an outer diameter of 400 mm and a width of 300 mm and rotated at a circumferential velocity of 30 m/s. The ejected molten alloy was rapidly quenched and solidified on the chill roll to produce alloy ribbons. An annealing process was conducted on each alloy ribbon under the conditions of annealing process shown in Table 8 to produce a soft magnetic alloy ribbon having a nano-crystalline structure. A width and thickness of each produced alloy ribbon are shown in Table 7. An outer circumferential portion of the chill roll was made of a Cu alloy having a thermal conductivity of 150 W/(m·K), the chill roll included a cooling mechanism inside to control the temperature of the outer circumferential portion. The heating rate from the room temperature to T1 was set at 400 to 500° C./sec. The density was measured after the annealing process.

The samples No. 7 to 9 each had a structure having a crystal grain with a grain diameter of 60 nm or less in an amorphous phase. In an observation of a cross-section of each sample, an area ratio of the crystal grain having a diameter of 60 nm or less was 50% or more (the observed field was 100%).

Tables 7 and 8 show the conditions of annealing process; and results of measurement of the lamination factor, the smoothness, $B_{8000}$, the iron loss, and the density measured after the annealing process for each sample. Sample No. 54 had the conditions of annealing process in which T2 was 140° C. less than the Fe—B compound deposition starting temperature and T1 was 160° C. less than the bccFe-crystallization starting temperature. Sample No. 55 had the conditions of annealing process in which T2 was 20° C. less than the Fe—B compound deposition starting temperature. The results of the measurement of No. 54 and 55 are also shown in Tables 7 and 8. Sample No. 54 had a low $B_{8000}$ at 1.74 T indicating insufficient annealing process. Sample No. 55 had a large increase in the iron loss, which was not measurable under the conditions of 1 T and 1 kHz. This suggests that the properties of sample No. 55 were deteriorated by the deposition of Fe—B compound. Also, in sample No. 55, creases were formed during the annealing process, which significantly lowered the lamination factor to 80% and the smoothness to 6.3 μm.

In the examples of the present disclosure (No. 7 to 9), the saturation magnetic flux densities were high, the iron losses were low, and the lamination factors were 86% or more. The densities were also high, and the smoothness was preferable.

TABLE 7

| No. | Composition (at %) Fe | Si | B | Nb | Mo | Cu | Width (mm) | Thickness (μm) | Lamination Factor (%) | Smoothness (μm) | $B_{8000}$ (T) |
|---|---|---|---|---|---|---|---|---|---|---|---|
| 7 | 82.93 | 2.30 | 13.70 | 0.38 | — | 0.69 | 214 | 31 | 91.0 | 1.0 | 1.77 |
| 8 | 82.93 | 2.30 | 13.70 | 0.38 | — | 0.69 | 214 | 34 | 89.0 | 1.6 | 1.77 |
| 9 | 82.93 | 2.30 | 13.70 | 0.38 | — | 0.69 | 214 | 29 | 89.0 | 2.1 | 1.77 |
| 54 | 82.93 | 2.30 | 13.70 | 0.38 | — | 0.69 | 214 | 31 | 89.0 | 2.1 | 1.74 |
| 55 | 82.93 | 2.30 | 13.70 | 0.38 | — | 0.69 | 214 | 31 | 80.0 | 6.3 | 1.77 |

TABLE 8

| No. | Iron Loss @1T/1 kHz (W/kg) | Density (g/cm3) | bccFe-Starting Temperature (° C.) Crystallization | Fe-B Starting Temperature (° C.) Deposition | T1 (° C.) | T2 (° C.) | Heating Rate from Room Temperature to T1 (° C./sec) | Heating Rate from T1 to T2 (° C./sec) |
|---|---|---|---|---|---|---|---|---|
| 7 | 7.5 | 7.50 | 510 | 620 | 390 | 520 | 430 | 60 |
| 8 | 8.0 | 7.50 | 510 | 620 | 390 | 520 | 430 | 60 |
| 9 | 7.9 | 7.50 | 510 | 620 | 390 | 520 | 430 | 60 |
| 54 | 4.7 | 7.49 | 510 | 620 | 350 | 480 | 430 | 60 |
| 55 | not measurable | 7.51 | 510 | 620 | 480 | 600 | 520 | 40 |

* Fe-B Deposition Starting Temperature in the table is the Fe-B Compound Deposition Starting Temperature.

[Lamination Factor]

The lamination factor was measured by a following method in accordance with JIS C 2534: 2017.

20 ribbons each cut in the length of 120 mm were laminated on one another and the laminated ribbons were placed on a flat sample stand. A flat anvil having a diameter of 16 mm was placed on the laminated ribbons at a pressure of 50 kPa. The height of the laminated ribbons was measured at every 10 mm in the width direction. The maximum height in the measurement was hmax (μm). The lamination factor LF was calculated from the following equation.

$$LF\ (\%) = \text{weight of sample (g)}/\text{density (g/cm}^3)/h\text{max (μm)}/\text{sample length (240 cm)}/\text{ribbon width (cm)} \times 10{,}000$$

As mentioned above, the present disclosure was able to provide the soft magnetic alloy ribbon with a high saturation magnetic flux density and a low iron loss. The present disclosure was also able to provide the soft magnetic ribbon having isotropy and a reduced anisotropy. The present disclosure was able to provide the soft magnetic alloy ribbon with a high density, a high lamination factor, and preferable smoothness.

A publicly known method may be used when producing a magnetic core by using the soft magnetic alloy ribbon of the present disclosure. Such a magnetic core produced by using the soft magnetic alloy ribbon of the present disclosure can have excellent properties of the soft magnetic alloy ribbon of the present disclosure, such as a high saturation magnetic flux density, a low iron loss, and isotropy.

Furthermore, a component including the magnetic core produced by using the soft magnetic alloy ribbon of the present disclosure and a coil can have excellent properties of the soft magnetic alloy ribbon of the present disclosure, such as a high saturation magnetic flux density, a low iron loss, and isotropy.

What is claimed is:

1. A soft magnetic alloy ribbon including an alloy represented by a composition formula of $Fe_aSi_bB_cCu_dM_e$, M being at least one type of element selected from a group consisting of Nb, Mo, V, Zr, Hf, and W, and the formula satisfying $82.5 \le a \le 86$, $0.3 \le b \le 3$, $12.5 \le c \le 15.0$, $0.05 \le d \le 0.9$, and $0 \le e < 0.4$ in at %, the soft magnetic alloy ribbon comprising:

a structure that has a crystal grain with a grain diameter of 60 nm or less in an amorphous phase, wherein a saturation magnetic flux density of the soft magnetic alloy ribbon is 1.75 T or more, wherein an iron loss of the soft magnetic alloy ribbon at 1 kHz and at 1 T is 25 W/kg or less, and wherein a lamination factor of the soft magnetic alloy ribbon is 86% or more.

2. The soft magnetic alloy ribbon according to claim 1, wherein a density of the soft magnetic alloy ribbon is 7.45 g/cm$^3$ or more.

3. The soft magnetic alloy ribbon according to claim 1, wherein a thickness of the soft magnetic alloy ribbon is 25 μm or more.

4. The soft magnetic alloy ribbon according to claim 1, wherein a magnetic flux density of the soft magnetic alloy ribbon when a magnetic field of 80 A/m is imposed in a casting direction of the soft magnetic alloy ribbon is a magnetic flux density L, and a magnetic flux density of the soft magnetic alloy ribbon when a magnetic field of 80 A/m is imposed in a direction orthogonal to the casting direction of the soft magnetic alloy ribbon is a magnetic flux density W, and wherein a ratio (L/W) of the magnetic flux density L to the magnetic flux density W is from 0.7 to 1.3.

5. The soft magnetic alloy ribbon according to claim 1, wherein a saturation magnetostriction of the soft magnetic alloy ribbon is 20 ppm or less.

6. The soft magnetic alloy ribbon according to claim 1, wherein the formula satisfies $83 \le a \le 86$, $0.3 \le b \le 2$, $0.4 \le d \le 0.9$, and $0 \le e \le 0.3$, and wherein a saturation magnetic flux density of the soft magnetic alloy ribbon is 1.77 T or more.

7. The soft magnetic alloy ribbon according to claim 1, wherein a part of Fe content is replaced with at least one type of element selected from Co and Ni up to 6 at % at a maximum.

8. A magnetic core formed by using the soft magnetic alloy ribbon according to claim 1.

9. A component comprising the magnetic core according to claim 8, and a coil.

10. A method of manufacturing the soft magnetic alloy ribbon of claim 1, the method comprising:

ejecting a molten alloy on a rotating chill roll; and quenching the molten alloy on the chill roll, wherein an outer circumferential portion of the chill roll is made of a Cu alloy having a thermal conductivity of 120 W/(m·K) or more.

* * * * *